US008453727B2

(12) United States Patent
Xu

(10) Patent No.: US 8,453,727 B2
(45) Date of Patent: Jun. 4, 2013

(54) DOWNHOLE ROTATIONAL VIBRATOR

(75) Inventor: Richard Yingqing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 197 days.

(21) Appl. No.: 13/106,012

(22) Filed: May 12, 2011

(65) Prior Publication Data

US 2012/0285686 A1 Nov. 15, 2012

(51) Int. Cl.
*E21B 31/107* (2006.01)

(52) U.S. Cl.
USPC ..... 166/177.6; 166/178; 166/301; 173/91

(58) Field of Classification Search
USPC ..... 166/301, 178, 177.6, 177.7; 173/91
See application file for complete search history.

(56) References Cited

U.S. PATENT DOCUMENTS 5,875,842 A * 3/1999 Wyatt ..... 166/178
6,474,421 B1 11/2002 Stoesz ..... 173/91
2005/0284624 A1* 12/2005 Libby et al. ..... 166/177.6

FOREIGN PATENT DOCUMENTS

EP 1541801 A2 * 6/2005

* cited by examiner

*Primary Examiner* — David Andrews
*Assistant Examiner* — Taras P Bemko
(74) *Attorney, Agent, or Firm* — Shawn Hunter

(57) ABSTRACT

A jarring device includes an outer housing which defines an axial flow path therethrough. An impact rotator is retained within the housing and is rotatable therewithin between a first rotational position and a second rotational position to create a jarring impact. A torsional spring biases the impact rotator toward the first rotational position. Fluid flow through the housing rotates the impact rotator from the first to the second rotational position.

15 Claims, 4 Drawing Sheets

DOWNHOLE ROTATIONAL VIBRATOR

BACKGROUND OF THE INVENTION

1. Field of the Invention

The invention relates generally to vibratory jarring devices used for removing devices from a flowbore.

2. Description of the Related Art

Jarring devices are used to remove objects from a flowbore. Typically, jarring devices are run into a flowbore and secured to a stuck device or object. Thereafter, the jarring device is actuated to generate jarring impacts which are delivered to the stuck device or object to free it from the flowbore. Jarring devices are described in U.S. Pat. No. 6,474,421, issued to Stoesz.

SUMMARY OF THE INVENTION

The present invention provides a jarring device that can be run into a flowbore on a running string and used to remove a stuck tool. The jarring device can be affixed to the stuck tool and then actuated to create jarring impacts that are imparted to the stuck tool in order to remove it from the flowbore.

An exemplary jarring device is described which includes an outer housing which defines an axial flow path therethrough. An impact rotator is retained within the housing and is rotatable therewithin between a first rotational position and a second rotational position. In the described embodiment, a torsional spring biases the impact rotator toward the first rotational position. Also in the described embodiment, fluid flow through the housing rotates the impact rotator from the first to the second rotational position.

Rotation of the impact rotator with respect to the housing creates jarring impacts which are transmitted through the housing to the stuck tool. In the described embodiment, impact surfaces on the impact rotator will impact complimentary impact surfaces on the housing.

BRIEF DESCRIPTION OF THE DRAWINGS

For a thorough understanding of the present invention, reference is made to the to following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
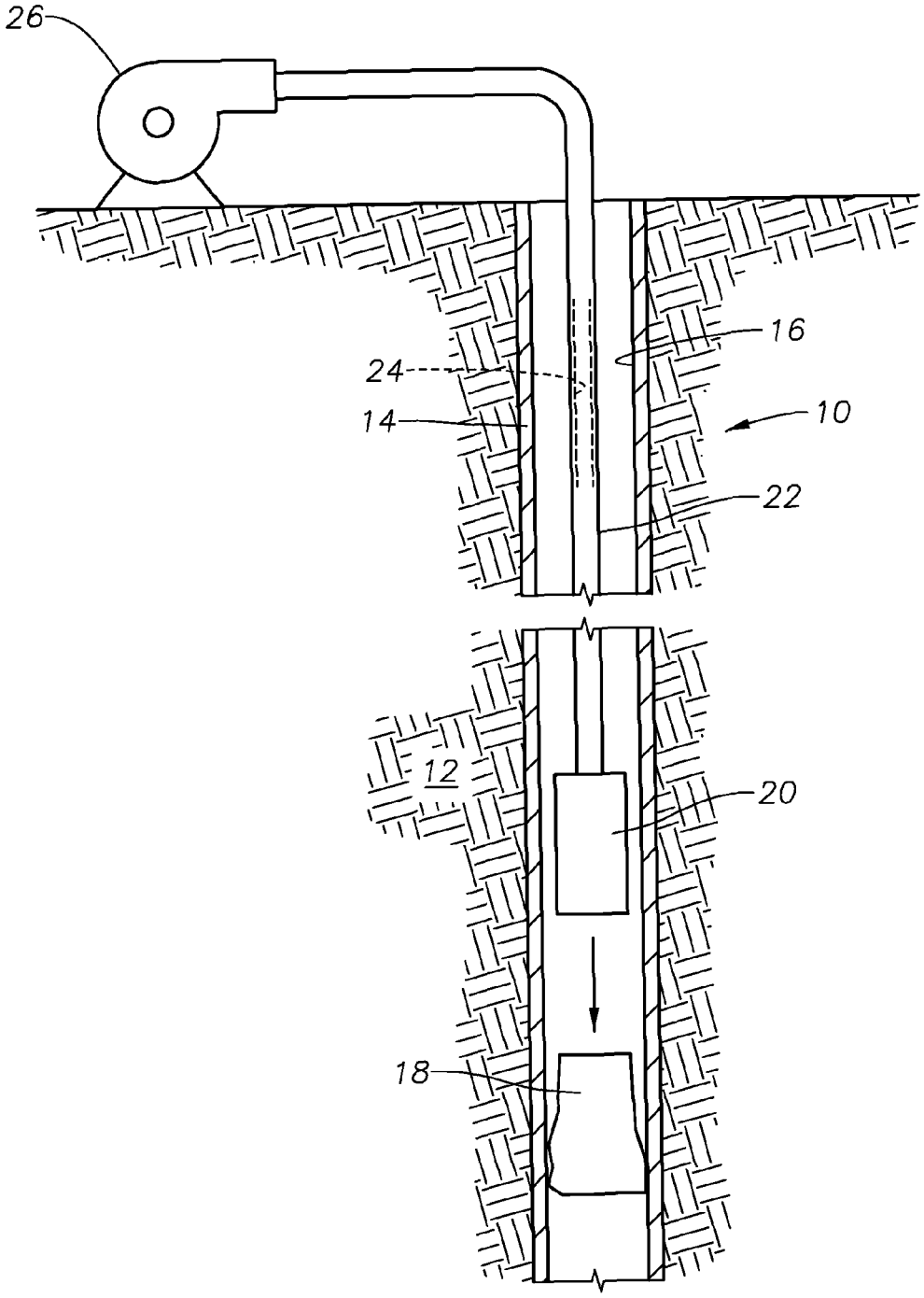
FIG. 1 is aside, cross-sectional view of an exemplary wellbore containing a vibrator device constructed in accordance with the present invention.

FIG. 1 depicts an exemplary wellbore 10 that has been drilled through the earth 12. The wellbore 10 is lined with casing 14 and defines a flowbore 16. The flowbore 16 contains a stuck tool 18 that must be removed by vibratory jarring. Although this example depicts the flowbore 16 which contains the stuck tool 18 as being defined by the wellbore casing 14, those of skill in the art will understand that the flowbore that contains a stuck tool might as well be defined within a concentric liner or within production tubing that is disposed within the casing 14.

A rotational vibrator 20 constructed in accordance with the present invention is shown being run into the wellbore 10 on a running string 22. The running string 22 may be conventional end-to-end tubing string sections or coiled tubing, of a type known in the art. The running string 22 defines a central flow passage 24 through which fluid can be flowed. The vibrator 20 is removably secured to the stuck tool 18 by a latch or fishing neck arrangement of a type well known in the art. A surface-based pump 26 is used to flow drilling fluid or other fluid through the central flow passage 24 to operate the vibrator 20 during operation.

Construction and operation of the exemplary rotational vibrator 20 are shown in detail in FIGS. 2-7. The vibrator 20 includes an outer housing 28 which defines first and second interior chambers 30, 32 which are separated by an inwardly projecting flange 34. An axial flow path through the housing 28 is defined by the first and second chambers 30, 32.

One or more impact blocks 36 extend from the flange 34 into the second chamber 32. In the embodiment depicted in FIGS. 2 and 5-7, there are two impact blocks 36. However, there may be more or fewer than two impact blocks 36. An exemplary structure for one of the two impact blocks 36 is best seen in the cutaway view of FIG. 5, which shows one of the two impact blocks 36. It should be understood that the half of the housing 28 that is not shown in FIG. 5 will have a second impact block 36 which essentially mirrors the one shown in FIG. 5. Each impact block 36 presents an inwardly-facing radial surface 38 that has a reduced diameter. The impact blocks 36 also present radially-facing first impact surfaces 40.

Figure 2:
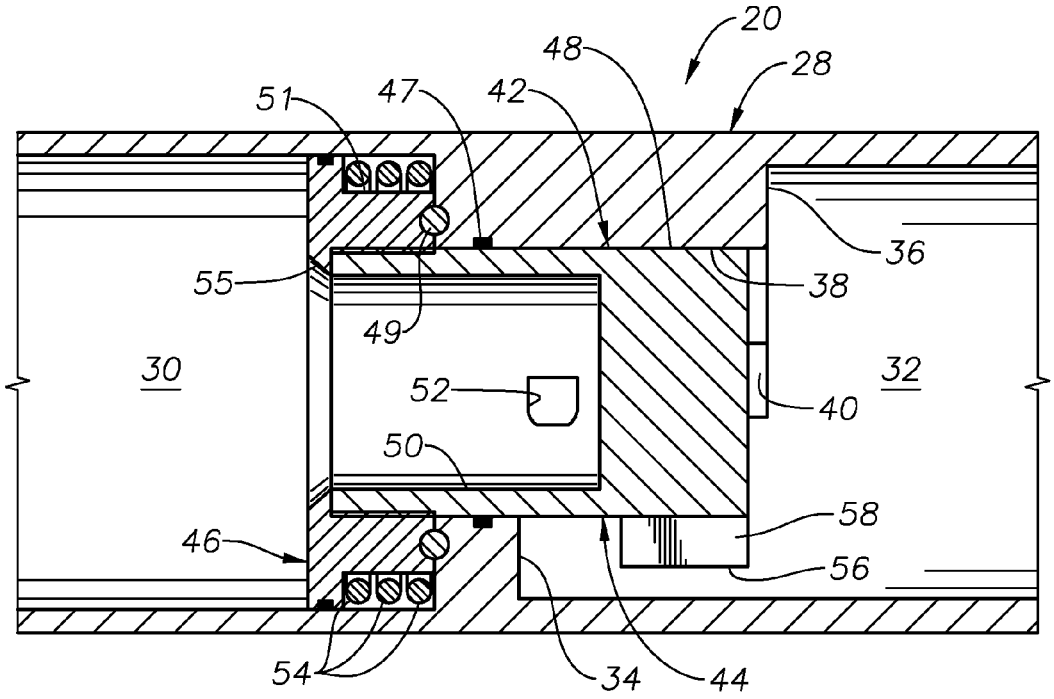
FIG. 2 is a side, cross-sectional view of an exemplary vibrator constructed in accordance with the present invention.

An impact rotator 42 is disposed within the housing 28. The exemplary impact rotator 42 depicted includes a lower impact portion 44 and an upper spring retaining portion 46. These two portions 44, 46, in the embodiment shown in FIG. 2, are made up of two separate pieces that are assembled together. The exemplary impact rotator 42 resides within the housing 28 such that the spring retaining portion 46 resides within the first chamber 30, and the lower impact portion 44 extends through the flange 34 and into the second chamber 32. A rotational bearing 49 (FIG. 2), of a type known in the art, is preferably disposed between the spring retaining portion 46 and the flange 34 to permit ease of rotation for the impact rotator 42 within the housing 28. Preferably also, an annular fluid seal 47 (also FIG. 2) is disposed between the impact portion 44 and the flange 34.

The spring retaining portion 46 is generally cylindrical in shape and presents an outer annular spring retaining groove 51 about its outer circumference. A torsion spring 54 is located within the spring retaining groove 51. Preferably, the torsion spring 54 is a coiled element. One end of the coiled element is affixed to the housing 28 while the other end is affixed to the spring retaining portion 46. The torsion spring 54 therefore retains the impact rotator 42 is a first rotational position (FIG. 6) with respect to the housing 28. When the impact rotator 42 is rotated within the housing 28 to a second rotational position (FIG. 7), the torsion spring 54 is stressed and will tend to bias the impact rotator 42 back toward the first position. A central axial opening 55 is formed within the spring retaining portion 46.

Figure 3:
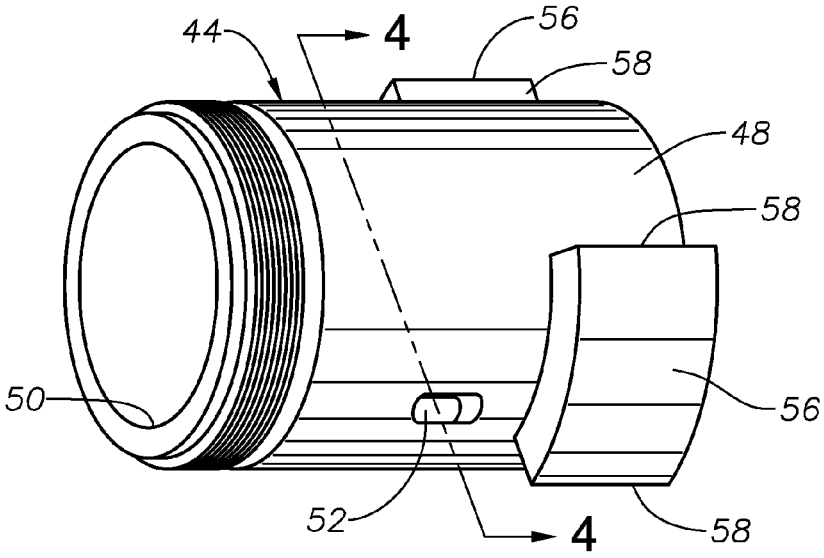
FIG. 3 is an external, isometric view of a portion of an exemplary impact rotator used within the vibrator shown in FIG. 2.
Figure 4:
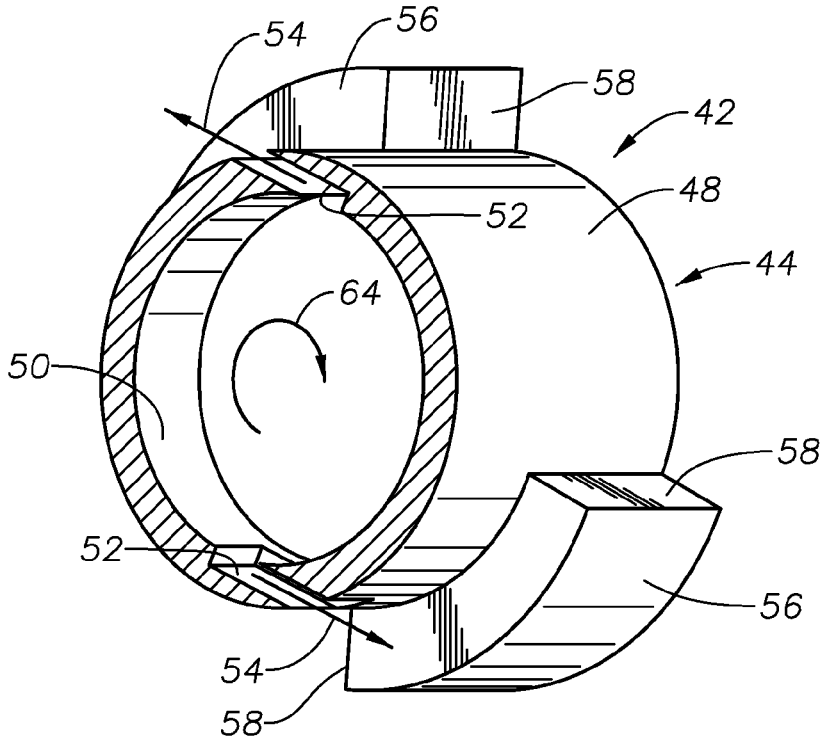
FIG. 4 is an isometric, cutaway view of a portion of the impact rotator shown in FIG. 3.
Figure 5:
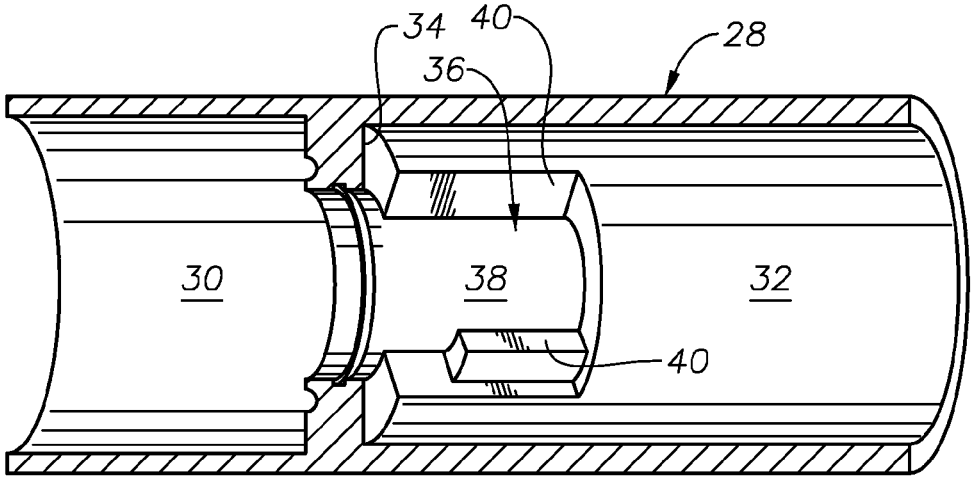
FIG. 5 is a side, cross-sectional view of the housing of the vibrator shown in FIG. 1.
Figure 6:
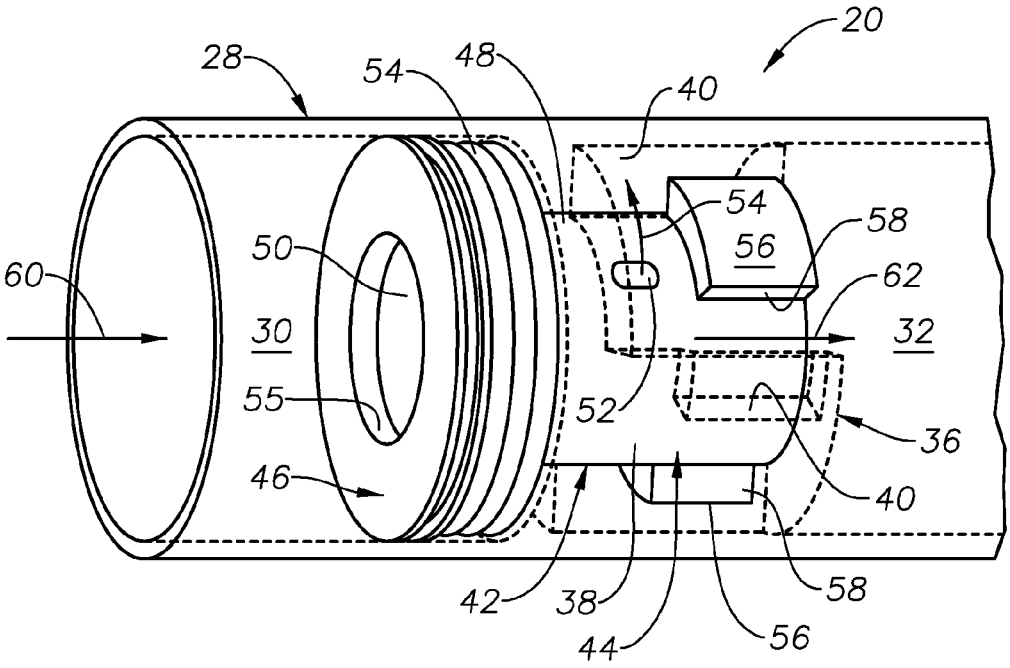
FIG. 6 is an isometric, partially transparent view of the vibrator shown in FIG. 1.

The impact portion 44 of the impact rotator 42 is depicted in FIGS. 3 and 4 apart from the other components of the vibrator 20. The impact portion 44 includes a central body 48 that is generally cylindrically shaped. A blind bore 50 is formed within the central body 48. Directional flow ports 52 are disposed through the central body 48 permitting fluid communication between the blind bore 50 and the exterior of the central body 48. As best seen in FIG. 4, the ports 52 are preferably oriented so as to flow fluid within the blind bore 50 outwardly along a generally tangential path, which is represented by arrows 54. Although two ports 52 are shown in the depicted embodiment, those of skill in the art will understand that there may be more or fewer than two such ports 52.

Impact shoulders 56 extend radially outwardly from the central body 48 and are shaped and sized to reside within the second chamber 32 of the housing 28. The impact shoulders 56 present radially-facing second impact surfaces 58.

Figure 7:
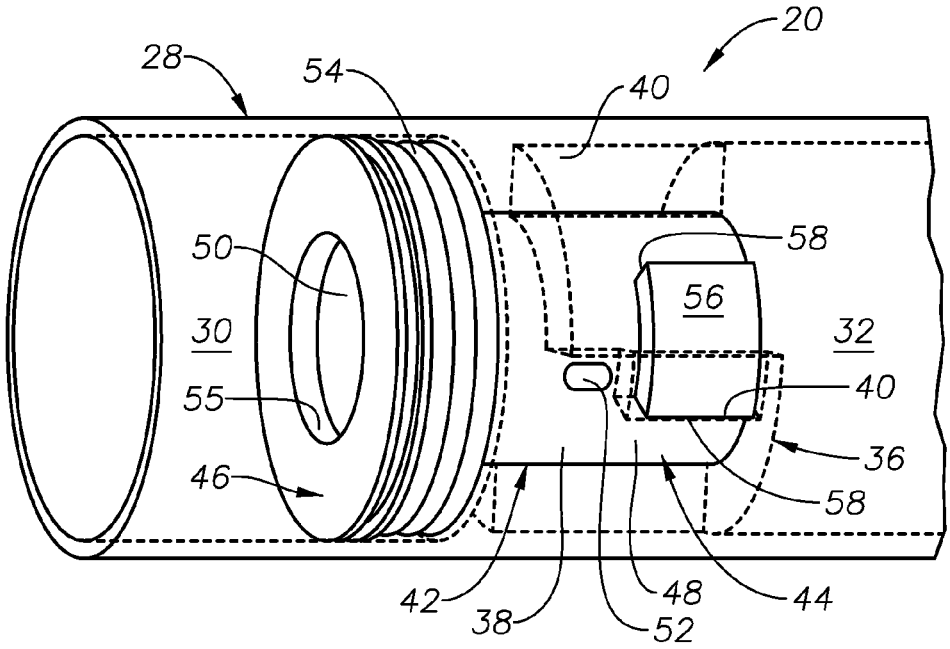
FIG. 7 is an isometric, partially transparent view of the vibrator of FIGS. 1 and 6, now having been moved to a position wherein an impact is created.

In operation, fluid is flowed by the pump 26 through the flow passage 24 of the running string 22. The fluid enters the first chamber 30 of the housing 28, as indicated by the arrow 60 in FIG. 6, and enters the blind bore 50. In the first rotational position, depicted in FIG. 6, the flow ports 52 are located so that they are not blocked by the impact blocks 36. As a result, fluid flowing in the direction of arrow 60 will exit the blind bore 50 through the directional flow ports 52 (arrow 54) and then exit into the second chamber 32 as depicted by arrow 62 in FIG. 6. As the fluid exits the flow ports 52, a rotational moment is imparted to the impact rotator 42 by this flow, causing the impact rotator 42 to rotate in the direction of arrow 64 in FIG. 4 from its first rotational position (FIG. 6) to the second rotational position (FIG. 7). In the second rotational position, the flow ports 52 are blocked by the reduced diameter interior radial surfaces 38 of the impact blocks 36, thereby precluding fluid flow through the flow ports 52 and through the housing 28. The second impact surfaces 58 of the impact shoulders 56 will impact against first impact surfaces 40 of the impact blocks 38 creating a jarring vibration which will be transmitted through the housing 28 of the vibrator 20 to the stuck tool 18. The torsion spring 54 will then return the impact rotator 42 to the first rotational position. Thereafter, the cycle of operation is repeated as fluid flow through the flow ports 52 again moves the impact rotator 42 from the first rotational position to the second rotational position and creates a second jarring vibration.

The invention also provides a method for removing a stuck device, such as device 18, from a flowbore 16. The vibrator 20 is run into the flowbore 16 and is engaged with the stuck device 18. Fluid is flowed through the flow passage 24 of the running string 22 and into the vibrator 20 and causes the vibrator 20 to create jarring impacts in a vibrating manner as described previously. The impacts are transmitted to the stuck device 18 until is removed from the flowbore 16.

Those of skill in the art will recognize that numerous modifications and changes may be made to the exemplary designs and embodiments described herein. The invention is limited only by the claims that follow and any equivalents thereof.

What is claimed is:

1. A vibratory device for removing an object from a flowbore comprising:

a housing defining a fluid flow path therethrough;

an impact rotator retained within the housing and rotationally moveable with respect to the housing between a first rotational position and a second rotational position, the impact rotator having a central body with a blind bore formed therein and at least one flow port formed within the impact rotator permitting fluid communication from the blind bore to the radial exterior of the impact rotator, the impact rotator being moveable between the first and second rotational positions in response to flow of fluid through the blind bore and flow port; and complimentary impact surfaces on the housing and the impact rotator such that rotation of the impact rotator to the second rotational position causes the impact surface to impact each other producing a jarring vibration.

2. The vibratory device of claim 1 further comprising a torsion spring to bias the impact rotator toward the first rotational position.

3. The vibratory device of claim 1 wherein the impact rotator further comprises:

an impact shoulder extending radially outwardly from the central body and presenting at least one of said complimentary impact surfaces.

4. The vibratory device of claim 1 wherein the flow port further comprises:

a directional flow port disposed through the central body to flow fluid from the blind bore through the central body along a path that is generally tangential to the central body.

5. The vibratory device of claim 3 further comprising an impact block formed within the housing and presenting at least one of said complimentary impact surfaces.

6. The vibratory device of claim 4 further comprising an impact block formed within the housing and presenting an inwardly-facing radial surface that will block fluid flow through the directional flow port when the impact rotator is in the second rotational position.

7. A vibratory device for removing an object from a flowbore comprising:

a housing defining a fluid flow path therethrough;

an impact block formed within the housing and presenting a first radially-facing impact surface;

an impact rotator disposed within the housing and presenting a second radially-facing impact surface that is complimentary to the first impact surface, the impact rotator having a central body with a blind bore formed therein and at least one flow port formed within the impact rotator permitting fluid communication from the blind bore to the radial exterior of the impact rotator; and wherein the impact rotator is rotatable between first and second rotational positions in response to flow of fluid through the blind bore and flow port to create a jarring impact in the second rotational position by moving the first impact surface into contact with the second impact surface.

8. The vibratory device of claim 7 further comprising a torsion spring to bias the impact rotator toward the first rotational position.

9. The vibratory device of claim 7 wherein the impact rotator further comprises:

an impact shoulder extending radially outwardly from the central body and presenting at least one of said complimentary impact surfaces.

10. The vibratory device of claim 9 wherein the flow port further comprises:

a directional flow port disposed through the central body to flow fluid from the blind bore through the central body along a path that is generally tangential to the central body.

11. The vibratory device of claim 10 further comprising an inwardly-facing radial surface that will block fluid flow through the directional flow port when the impact rotator is in the second rotational position.

12. A method of freeing a stuck device from a flowbore comprising the steps of:

a) disposing a vibratory device into a flowbore that contains the stuck device, the vibratory device having:

a housing defining a fluid flow path therethrough;

an impact rotator retained within the housing and rotationally moveable with respect to the housing between a first rotational position and a second rotational position; and complimentary impact surfaces on the housing and the impact rotator such that rotation of the impact rotator to the second rotational position causes the impact surface to impact each other producing a jarring vibration;

b) securing the vibratory device to the stuck device;

c) rotating the impact rotator to the second rotational position by flowing fluid from a central body of the impact rotator through a port formed in the impact rotator to the radial exterior of the impact rotator.

13. The method of claim 12 further comprising the steps of:

rotating the impact rotator from the second rotational position to the first rotational position; and rotating the impact rotator to the second rotational position to create a second jarring vibration.

14. The method of claim 13 wherein the step of rotating the impact rotator from the second rotational position to the first rotational position further comprises biasing the impact rotator with a torsion spring.

15. The method of claim 12 further comprising the step of blocking fluid flow through the housing when the impact rotator is in the second rotational position.

* * * * *